United States Patent [19]

Scheie

[11] 4,334,681

[45] Jun. 15, 1982

[54] GAME APPARATUS FOR USE WITH A PADDLE AND A BALL

[75] Inventor: Carl E. Scheie, Libertyville, Ill.

[73] Assignee: Brunswick Corporation, Skokie, Ill.

[21] Appl. No.: 97,736

[22] Filed: Nov. 26, 1979

[51] Int. Cl.[3] ..... A63B 67/04; A63B 71/04

[52] U.S. Cl. ..... 273/30; 273/76; 273/395

[58] Field of Search ..... 273/5 R, 30, 309, 411, 273/395, 76; 35/62

[56] References Cited

U.S. PATENT DOCUMENTS

| | | | |
|---|---|---|---|
| 1,410,171 | 3/1922 | Davis | 273/5 R |
| 2,066,724 | 1/1937 | Forsyth | 273/30 |
| 2,161,463 | 6/1939 | Frost | 273/30 |
| 2,614,839 | 10/1952 | Forsyth | 273/30 |
| 2,629,594 | 2/1953 | Forsyth | 273/30 |
| 2,711,899 | 6/1955 | Forsyth | 273/30 |
| 2,781,194 | 2/1957 | Sistrunk | 273/30 |
| 3,133,734 | 5/1964 | Latham | 273/30 |
| 3,468,039 | 9/1969 | Dubbert | 35/62 X |
| 3,738,653 | 6/1973 | Simpson | 273/76 UX |
| 4,146,225 | 3/1979 | Hallett et al. | 273/30 |

FOREIGN PATENT DOCUMENTS

| | | | |
|---|---|---|---|
| 523059 | 3/1956 | Canada | 273/30 |
| 755648 | 9/1933 | France | 273/5 R |
| 13987 | of 1902 | United Kingdom | 273/30 |
| 24288 | of 1912 | United Kingdom | 273/30 |
| 856394 | 12/1960 | United Kingdom | 273/30 |
| 1261208 | 1/1972 | United Kingdom | 273/30 |

*Primary Examiner*—Anton O. Oechsle

*Attorney, Agent, or Firm*—Wegner, Stellman, McCord, Wood & Dalton

[57] ABSTRACT

The invention comprises a game in which each opposing player utilizes a racquet, a paddle, or a hand to propel a ball onto a game board apparatus having three playing surfaces. These playing surfaces are related to one another at angles which are within a specified range. The rules of the game require that the ball come into contact with the surfaces in a specified order both while serving and during play. The game utilizes a game board that may be incorporated into furniture, may be wall mounted, or may be on a free-standing base.

13 Claims, 9 Drawing Figures

FIG. 1
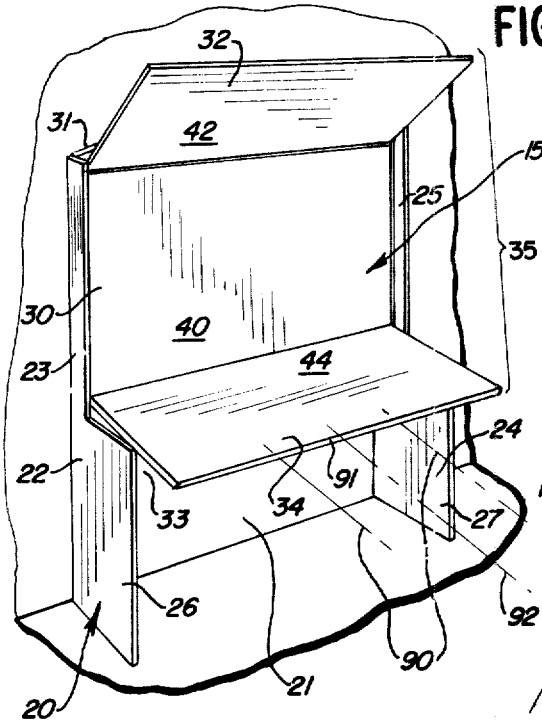
FIG. 3
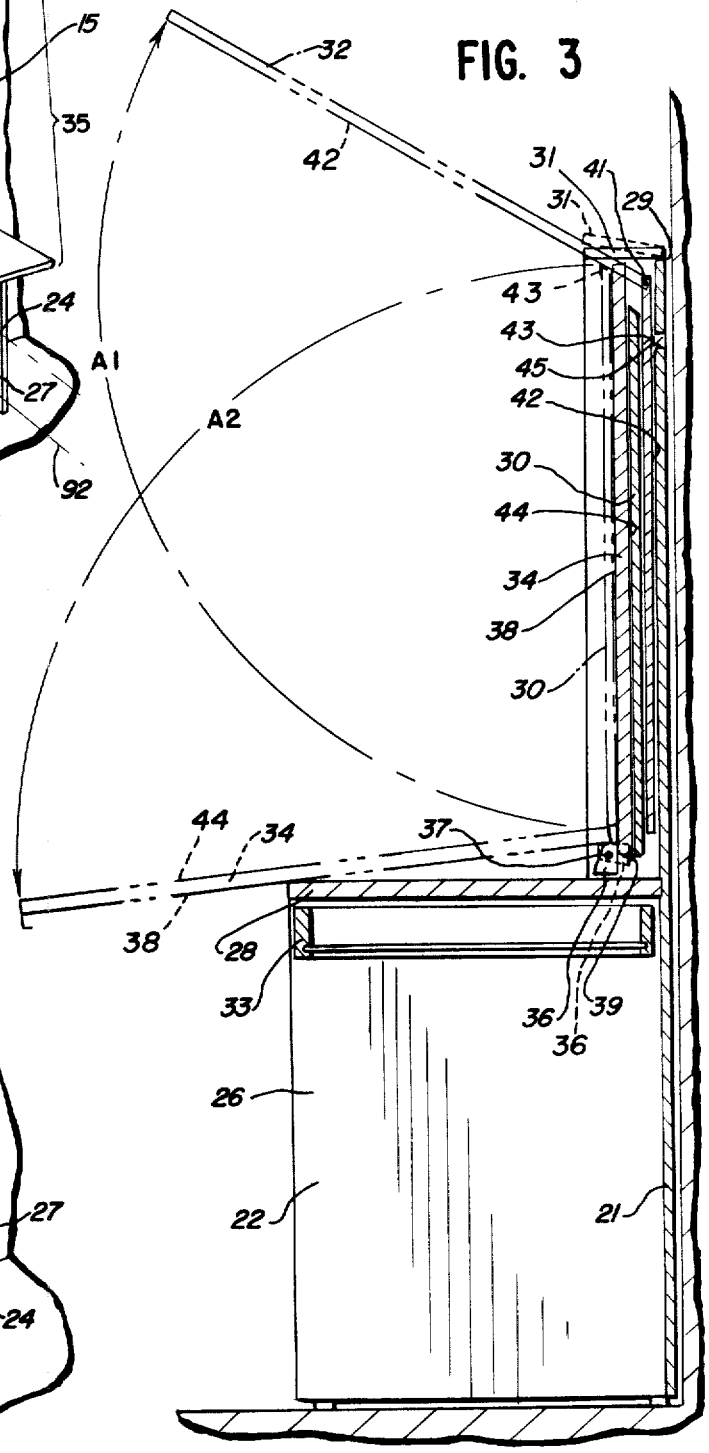
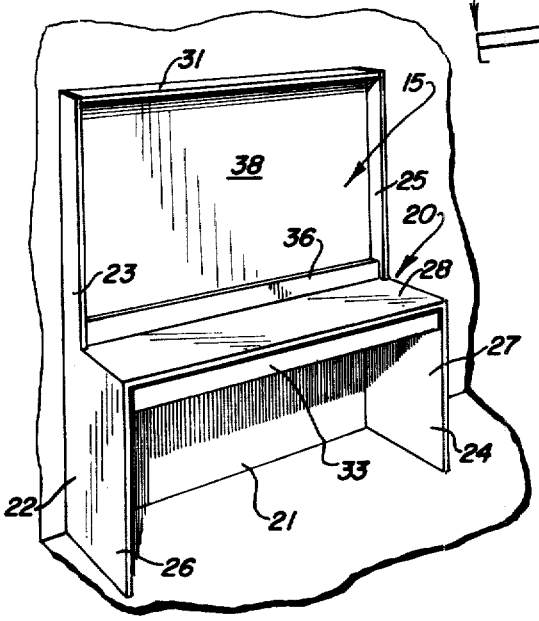
FIG. 2

FIG. 7
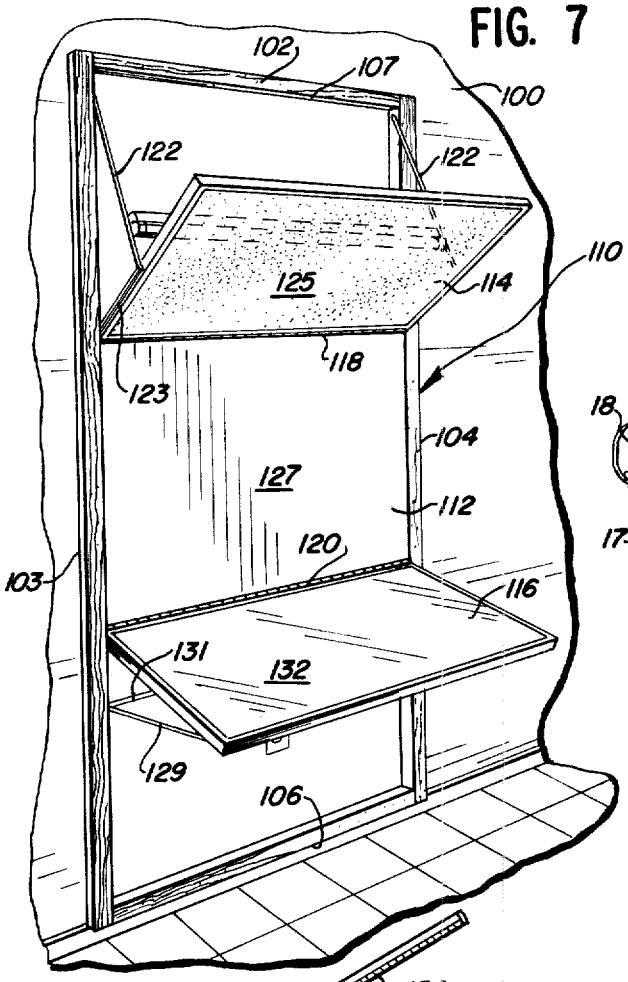
FIG. 8
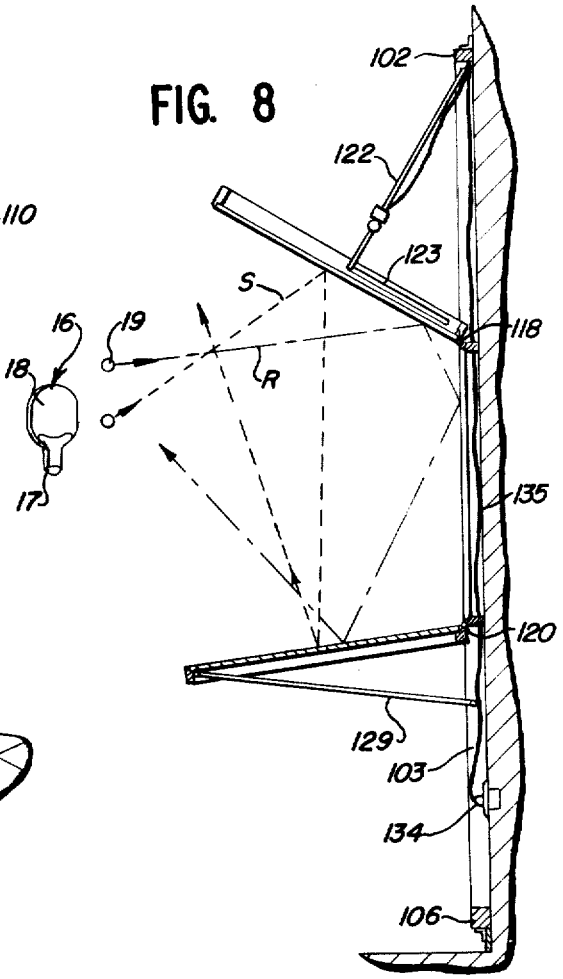
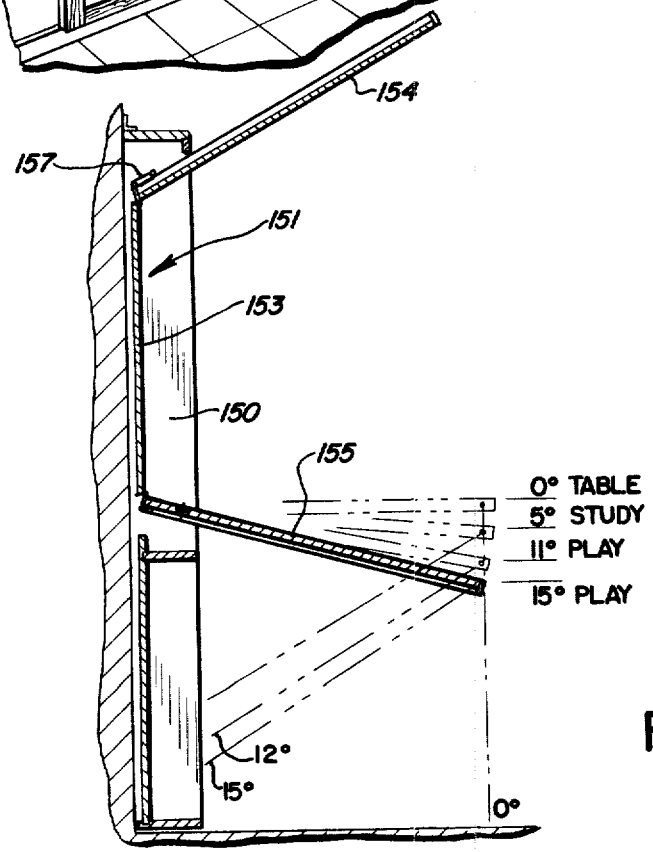
FIG. 9

GAME APPARATUS FOR USE WITH A PADDLE AND A BALL

DESCRIPTION

1. Technical Field

This invention relates to a game and, more particularly, to a game played on a game board which has three playing surfaces angled with respect to each other.

2. Background Art

Paddle games utilizing multiple playing surfaces are well known in the prior art. Such games have been of two general types. The first such type, as exemplified by U.S. Pat. No. 2,711,899, employs a generally horizontal playing surface or court, such as a table or platform, with a generally vertical end or abutment surface secured at one end thereof and two generally vertical side walls which extend along and are secured to the sides of the generally horizontal court from the side edges of the abutment wall toward the front or player position of the apparatus. This game apparatus is particularly adapted for playing a game somewhat similar to table tennis, but on a court of approximately one-half the length that is required of a table tennis court. In play, two opponents strike the ball alternately against the abutment wall from the player position end of the court. The rules are generally similar to those used in table tennis, although variations are also used. The side walls function to prevent a struck or rebound ball from leaving the court laterally before it reaches the player position end of the court.

The second type of ball game utilizing multiple playing surfaces, as taught by U.S. Pat. No. 4,146,225, employs two generally horizontal playing surfaces, one suspended above the other. In this type of game, a ball or other missile is bounced off one surface so that it hits the second surface. One or both surfaces may be irregular, thereby imparting random bounces to the ball and making the game more difficult.

The primary disadvantage of the first type of multi-surface paddle games is that a relationship between the height and inclination of the abutment wall and the length of the horizontal court is such that a ball struck against the abutment wall at any height will always rebound onto the court. This "funneling" of the ball to the player position end of the apparatus is aided by the side walls which prevent a ball, rebounding from the abutment wall, from leaving the court laterally before it reaches the player end of the court. This limits the diversity, skill and competitiveness with which the game can be played. The primary disadvantage of the second type of game is that it requires that the playing surfaces be located in the approximate center of the room. This ensures that the players may move around the circumference of the bottom playing surfaces when returning a ball. Therefore, when the game is being utilized, no other use can be made of the area completely around the playing surfaces. If the room is not very large, playing the game will result in the inability to utilize the room for any other purpose.

Furthermore, the upper playing surface in the game of U.S. Pat. No. 4,146,225, is relatively inaccessible so that it must either be a permanent fixture attached to the ceiling of the room or one which can only be removed with extreme difficulty.

The present invention is directed to overcoming one or more of the problems as set forth above.

DISCLOSURE OF INVENTION

In one aspect of the present invention, each player utilizes a racquet, a paddle or a hand to propel the ball onto a game board having three playing surfaces. The playing surfaces mate together at angles which are within a specified range. The rules of the game require that the ball must come into contact with the surfaces in a specified order both while serving and during play.

The game board has three planar members with the first planar member being a backboard with a vertical playing surface. A second planar member forms an upper playing surface and the third planar member forms a lower playing surface. The three playing surfaces are disposed at particular angles with respect to each other. The three planar members forming the three playing surfaces may be hinged together or may be connected in any suitable fashion so that the upper and lower playing surfaces may be moved out of the way when the game is not in use. The three playing surfaces do not interfere with the ball traveling in a lateral direction and, hence, vigorous lateral play is not restricted. Furthermore, the apparatus may be utilized in combination with furniture, thereby eliminating the need for separate storage space.

Other features of the invention will be apparent from the following description and from the drawings. While illustrative embodiments of the invention are shown in the drawings and will be described in detail herein, the invention is susceptible of embodiment in many forms and it should be understood that the present disclosure is to be considered as exemplifications of the principles of the invention and is not intended to limit the invention to the embodiments illustrated.

BRIEF DESCRIPTION OF DRAWINGS

FIG. 1 is a perspective view showing the game board of the present invention in a fully extended position;

FIG. 2 is a view similar to FIG. 1 showing the game board in a fully retracted position;

FIG. 3 is a side elevational view showing the game board in a fully retracted and a fully expanded position;

FIG. 7 is a perspective view of a wall-mounted embodiment of the game board;

FIG. 8 is a side elevational view showing the wall-mounted embodiment of FIG. 7 in conjunction with a paddle and ball; and FIG. 9 is a side elevational view of a second wall-mounted game board.

BEST MODE FOR CARRYING OUT THE INVENTION

Figure 4:
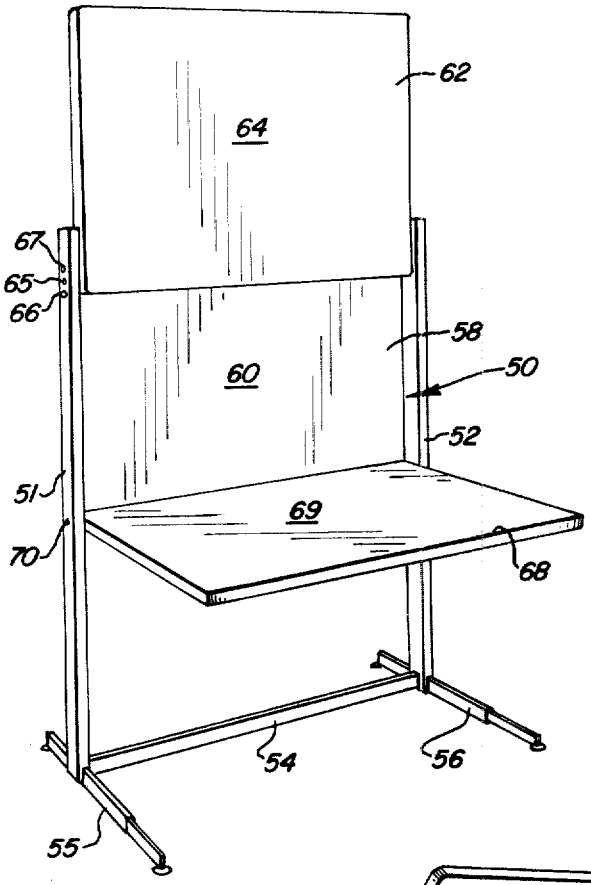
FIG. 4 is a perspective view of a freestanding embodiment of the game board.

Referring to FIGS. 1, 2 and 3, a first embodiment is illustrated in which the game board 15 of the present invention may form a part of a cabinet 20 which may be utilized for purposes other than playing the game. The cabinet 20 includes a relatively high back support member 21 having a pair of L-shaped side support members 22 and 24 mounted in parallel fashion substantially perpendicular to said back support member 21. The vertical legs 23,25 of the L-shaped side support members 22,24, respectively, extend along the side edges of the back support member 21 from the approximate midportion of the back support member 21 to the top of the cabinet 20. A top wall 31 extends between the top edges of the vertical legs 23,25 and is pivoted by a hinge 29 to the top edge of said back support member 21. The horizontal legs 26,27 of the L-shaped side support members 22,24 have substantial vertical height extending from the floor or bottom edge of the back support member 21 to said approximate midportion of said back support member 21. Mounted on the top edge portion of the horizontal legs 26,27, and attached to the back support member 21, is a horizontal member 28 which may have a writing surface, or the like, facing upwardly therefrom. As illustrated, a drawer 33 is slidably mounted below the horizontal member 28 and can be used to store the game apparatus, to be described hereinafter, or can be used to store writing materials, or the like. It is to be understood that a larger storage area may be built into the lower portion of the cabinet 20 for mounting record playing equipment or other such devices. The horizontal member 28 may be hinged (not shown) to the back support member 21 for pivoting upward to an open position when the game is in the stored condition. The various pieces of the cabinet 20 may be constructed of any suitable material, such as wood.

The game is played on a three-part playing surface 35 which, as shown in FIGS. 1 through 3, consists of three planar members 30, 32 and 34 which are pivotally mounted between the vertical legs 23,25 of the side support members 22 and 24 so as to be retractable into a closed position, as shown in FIG. 2, when not in use. The three planar members 30, 32 and 34 may be constructed of any suitable material, such as a translucent-type plastic, which allows illumination and provides a suitable playing surface. The material of the playing surfaces should afford a uniform bounce to the ball.

The game, in general, is played on the threepart playing surface 35 which includes a backboard, having a vertical playing surface 40 formed on the first planar member 30; an upper board, angled upwardly and forwardly with respect to the backboard and forming an upper playing surface 42 on the second planar member 32; and a lower board, angled downwardly and forwardly with respect to said backboard and forming a lower playing surface 44 on the third planar member 34. As shown in FIG. 3, the cabinet 20 stores the three planar members 30,32,34 in a unique stacked order in a storage compartment formed by the two vertical legs 23,25, the back support member 21 and the pivoted top wall 31. The planar member 34, having the playing surface 44 facing rearward has an overlapping bordering strip 36 extending between the side edges thereof with pivot pins 37 extending longitudinally of said strip 36 into pivot contact with said vertical legs 23,25. An opposite surface 38 of planar member 34 faces forward, see FIGS. 2 and 3, when the planar member 34 is in the stored position. A picture, mirror, or the like, may be mounted on the surface 38 for viewing when the game board is folded and the cabinet 20 is serving as a piece of furniture. The planar member 34 has a hinge 39 attached to the bottom edge thereof, with the other half of said hinge 39 being attached to the bottom edge of the planar member 30.

At the time that the planar member 34 is pivoted forward and downward, the planar member 30 is, likewise, pivoted downward with the two playing surfaces 44,40 of the planar members 34,30, respectively, facing each other. The third planar member 32 has a pair of sidewardly extending pivot pins 41 which engage in pivoting rotation with the upper portion of the vertical legs 23,25. The third planar member 32 has an angled strip 43 secured to the face portion thereof near the pivoted edge of the playing surface 42 thereof. The angled strip 43, when the planar member 32 is in the stored condition, projects rearward through a slot 45 in the back support member 21. After the planar members 34,30 are pivoted forward, as described above, the planar member 32 is pivoted upwardly to a position above the horizontal and, in the process, raises the top wall 31 slightly. The planar member 30 is then pivoted from contact with planar member 34 until its playing surface 40 is angled slightly rearwardly and the top edge of planar member 34 has cleared the angled strip 43. The planar member 32 is then lowered with the angled strip 43 forward of the planar member 30. The top edge of planar member 30 is moved forward to nest behind the angled strip 43, whereupon the assembly of the game board 15 is completed. The planar member 34, in the downwardly and forwardly extending position, forms a support for the planar backboard member 30.

With the game board 15 erected ready for play, the planar backboard member 30 has the vertical playing surface 40 lying generally in a plane parallel to the back support member 21. The upper playing surface 42 on the planar member 32 forms an angle A-1 with the surface 40 of the planar backboard member 30, while the lower playing surface 44 on the planar member 34 forms an angle A-2 with said planar backboard member 30.

In one preferred embodiment, angle A-1 is equal to approximately 125° and angle A-2 is variable between 102° and 105° with respect to the planar backboard member 30. As shown in FIG. 3, the angle is 105°, which angle can be reduced by spacers or the like between the opposite surface 38 of planar member 34 and the horizontal member 28.

With the game board assembled, the angle A-2 between the vertical playing surface 40 and the lower playing surface 44 determines the speed and type of game being played. That is, with Angle A-2 at 102° the game is played slower and more casually. At an angle A-2 of 105° the game is played faster and more competitively. A competitive game is a game that rewards good shots, does not induce trick shots, is not biased toward a given style and demands some general athletic abilities, such as reaction and coordination. A casual game is one that is easy to initiate and maintain good volleys.

One preferred and operative set of specifications for the game board 15 is as follows:

The vertical playing surface 40:48" wide—24" high. The lower edge of surface 40:30" from floor.

The upper playing surface 42:48" wide—30" high (deep). The angle A-1 between the upper playing surface 42 and the vertical playing surface 40 is within the range of 115° to 135°.

The lower playing surface 44:48" wide—30" high (deep). The angle A-2 between the lower playing surface 44 and the vertical playing surface is within the range of 95° and 105°.

One preferred and operative specification for a ball 19 and paddle 16 is as follows:

Ball 19: Weight—4.5 gram (5/32 oz.). Size—4.125 cm. (1⅝") DIAM. Rebound—40 cm from a 100 cm drop Paddle 16—Weight—125 grm. (maximum) (4.4 oz.) Size—No dimension to exceed 28 cm. (11 in.) Curvature of edge—maximum radius ⅛".

Figure 6:
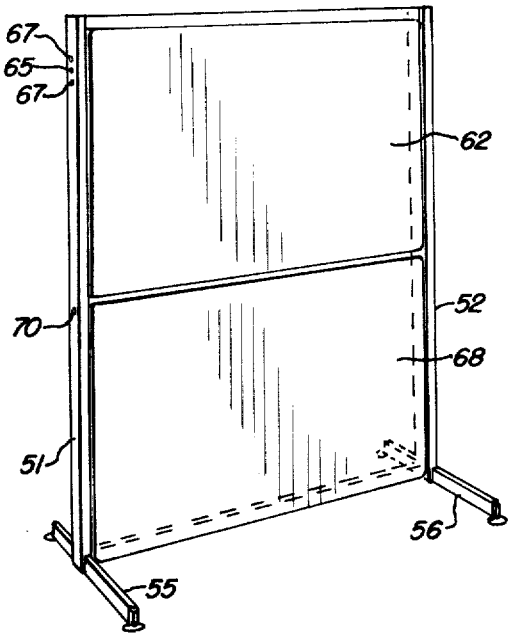
FIG. 6 is a view similar to FIG. 4 showing the game board in a fully retracted position.
Figure 5:
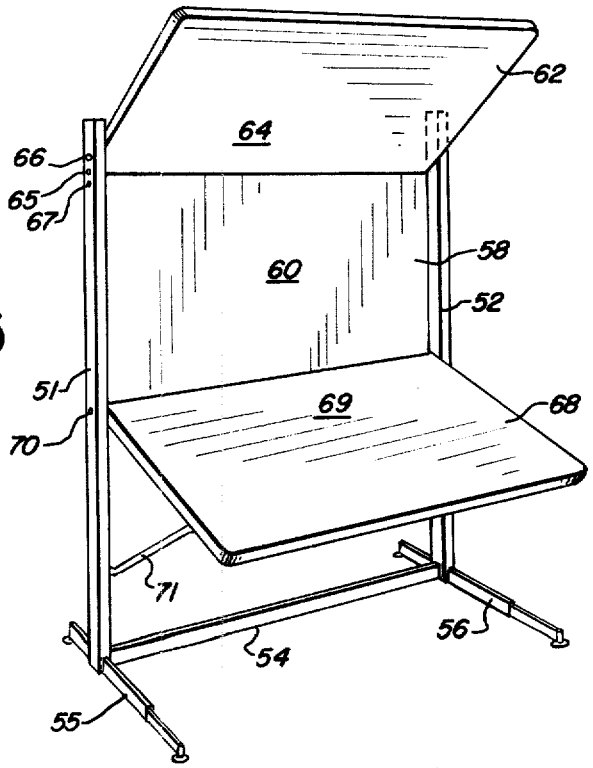
FIG. 5 is a view similar to FIG. 4 showing the game board in a fully expanded position.

Referring to FIGS. 4 through 6, a freestanding game board 50 is illustrated and includes a pair of spaced vertical supports 51,52 joined by a stretcher 54. Forwardly and rearwardly extending floorengaging bars 55,56 are rigidly connected to the juncture of the stretcher 54 and the vertical supports 51,52. The bars 55,56 may be telescopically extendible forwardly of the vertical supports 51,52 to afford extra support for any weight that may be distributed off center in a forward direction from the vertical supports 51,52. A first planar member 58, forming a backboard with a vertical playing surface 60, is rigidly attached between the vertical supports 51,52, with the lower edge of the planar member 58 being the desired distance off the floor upon which the game board 50 is standing.

A second planar member 62, forming an upper playing surface 64, is pivoted by pins 65 to the vertical supports 51,52. In the stored position, as shown in FIG. 6, the planar member 62 hangs down and covers the playing surface 60 of the planar member 58. A pair of pins 66 are insertable through one of two apertures 67 in each vertical support 51,52 to engage in mating openings in the side edges of the planar member 62 to position the planar member 62 at one of two desired angular positions relative to the vertical planar member 58 so that the upper playing surface 64 is angled upwardly and forwardly of the vertical backboard playing surface 60 of the planar member 58.

A third planar member 68, forming a lower playing surface 69 on one planar side thereof, is pivotally mounted by pins 70 to the midportion of the vertical supports 51,52. In the stored position of FIG. 6, the third planar member 68 hangs down between the vertical supports 51,52 and below the second planar member 62. The third planar member 68 is pivoted about pins 70 to a position with the lower playing surface 69 angled downwardly and forwardly of the vertical backboard playing surface 60. Appropriate adjusting means, such as a bail type bracket 71, is provided between the third planar member 68 and the vertical supports 51,52 to set the desired angle of the lower playing surface 69 relative to the vertical playing surface 60. The bracket 71 pivots on the vertical supports 51,52 and seats in one of three different slots on the undersurface of the third planar member 68 to set the desired angle. The angles of the respective planar members 62,68 to the vertical planar member 58 are the same as described with respect to FIGS. 1 through 3.

Referring now to FIGS. 7 and 8, a further embodiment of the game board is shown as permanently mounted on a wall 100. The apparatus includes a frame 102 attached to the wall 100 and includes a pair of spaced apart vertical sides 103,104 and a pair of spaced apart horizontal sides 106,107. The game board 110 includes three planar members 112,114,116, with the first planar member 112 being secured to the vertical sides 103,104 at the appropriate height above the floor. The second planar member 114 is hinged by hinge 118 to the top edge of the first planar member 112 and the third planar member 116 is hinged by hinge 120 to the bottom edge of said first planar member 112. To support the second planar member 114 at an appropriate angle to the first planar member 112, a pair of struts 122 are pivotally attached at one end to the frame 102 and are connected to a track 123 in each of the opposite side edges of the planar member 114. The struts 122 are locked in an appropriate position in the tracks 123, as by a catch or bolt (not shown), to hold a playing surface 125 on said planar member 114 at an appropriate angle to the playing surface 127 on the first planar member 112. A U-shaped bracket 129 is used to angularly support the planar member 116 relative to the planar member 112. The ends of the legs of the "U" of the bracket 129 are pivoted to the underside of the planar member 116. The crossbar 131 of the bracket 129 is movable into one of several notches (not shown) formed in the sides 103,104 of the frame 102 to locate a playing surface 132 on said third planar member 116 at the desired angle relative to the vertical playing surface 127 on planar member 112. The third planar member 116 extends forwardly and downwardly relative to the first planar member 112 to provide the lower playing surface 132 for the game. The angle of the lower playing surface 132, relative to the playing surface 127 on planar member 112, is varied within the same range specified in FIGS. 1 through 3.

FIG. 8 shows an electrical outlet 134 connected to a light bar 135, or the like, behind a translucent panel forming the first planar member 112. The light bar 135 will illuminate the playing surface 127 and the game area in general.

FIG. 9 shows a modification of the form of game board shown in FIGS. 7 and 8 and comprises a wall cabinet 150 in which the three-part game board 151 is stored. The game board 151 has a first planar member 153 fixed to the cabinet 150 and is hinged, at the top, to the bottom of a second planar member 154 and, at the bottom, to the top of a third planar member 155. The second and third planar members 154,155, respectively, may be stacked against the first planar member 153 by swinging, first, the third planar member 155 upward against the first planar member 153 and then, due to the offset hinge 157, swing the second planar member 154 down against said third planar member 155. A hook could be used to secure the game in the collapsed condition. The angled relationship of the second and third planar members 154,155 to the first planar member 153, and the method of accomplishing same, are within the context of the structures described in FIGS. 1 through 3.

FIG. 9 illustrates four different angular positions of the third planar member 155 with respect to the vertical or first planar member 153. The 0° position (90° to the vertical) is the position used when the board is serving as a table. The 5° (downward) position is the position of the board when the board is used as a study surface. The 11° and 15° positions are the extreme playing positions of the game as was described in the example of FIGS. 1–3.

The game will now be described with reference to the accompanying drawings and specifically with respect to FIGS. 1 through 3, 8 and 9. It is understood that the rules may be changed or modified in certain respects without departing from the primary spirit or scope of the invention.

The game is played with the paddle 16 (FIG. 8), having no dimension greater than approximately eleven inches, with a handle 17 and a striking surface 18. The ball 19 can be any rebounding-type ball, such as a Ping Pong ball, but it is preferred that a ball of the type of the so-called golf "whiffle ball" be used.

The objective of the game is for one player to win each volley by serving or returning the ball 19 so that the opponent is unable to return the ball in such a manner that it remains in play. Points are scored only by the server. When the server loses a volley, the opponent wins the serve. A game is won by the first player scoring eleven points, unless both players have scored ten points; then the winner of the game shall be the first player to win two more points than his opponent.

A coin is tossed to determine the player who will serve first. A service zone is defined by the edge 91 of the lower playing surface 44 of planar member 34 (farthest from the vertical backboard playing surface 40 of planar member 30) and a pair of imaginary lines 90 located a specified distance, such as fourteen inches, on either side of a centerline 92 of said lower playing surface 44. The service zone is the area between two vertical planes lying perpendicular to the edge 91 of the lower playing surface 44 which planes contain the two imaginary lines 90. The service zone is approximately 28" wide and extends back from the game board. The service zone should be about ½ the width of the playing surface.

At the moment of the impact of the paddle 16 on the ball 19 in service, both the ball contact point of the paddle 16 and the ball 19 must be in the service zone. The serve is executed by the server releasing the ball 19, without imparting spin, and striking it with the paddle 16. The serve must hit the upper playing surface 42 first and then the lower playing surface 44 before it is returned, see the dotted line "S" illustrated in FIG. 8. The serve may not hit the vertical playing surface 40 as illustrated by the dashed lines "R" of FIG. 8. If the server fails to comply with the above results, service then shifts to the other player.

The receiver of a service must not assume a position that will interfere with the server. After a ball 19 is legally served, the returned ball must hit the upper playing surface 42 first. It may then hit the vertical playing surface 40 before it hits the lower playing surface 44, or it may go directly from surface 42 to the surface 44 as illustrated by both the dotted and dashed lines of FIG. 8, respectively. This process is repeated by the players alternately until one loses the volley. After the ball hits the lower playing surface 44, it must be returned by the opponent before it hits the lower playing surface 44 again or before it hits the floor.

The volley is lost by a player if either the player's body or his paddle 16 contacts any part of any of the playing surfaces 40,42,44. Similarly, the volley is lost if the serve or the return hits the upper playing surface 42 after it hits either the lower playing surface 44 or the vertical playing surface 40. The volley is also lost if a player deliberately interferes with the opponent (called an "avoidable hinder").

The volley is replayed if a player unintentionally interferes with the opponent (called an "unavoidable hinder"). Similarly, if a player is struck by the opponent's return ball before the ball hits the playing surfaces 40,42,44, the point is played over.

If a player is struck by a ball that is in play after it has been legally returned, the opponent wins the volley. Similarly, if any part of the hand or body of a player touches the ball in the act of striking the ball with the paddle, the volley is lost.

The game may also be played without the use of a paddle in a manner similar to the familiar game of handball. The player's hand becomes the paddle and a softer, bouncier ball is used. The ball would be similar to a familiar handball, only smaller, i.e. of the size generally specified for the ball 19 of the first described embodiment of the invention. The rules of the game are substantially the same as in the paddle-type game.

I claim:

1. A game apparatus for use with a paddle and a ball, comprising:

a first planar member having a generally vertical substantially flat playing surface lying substantially perpendicular to a floor upon which two players stand;

a second planar member having a playing surface intersecting along one edge with said first planar member, said playing surface of said second planar member being above said first planar member and being disposed at an angle within the range of 115° and 135° with the playing surface of said first planar member; and a third planar member having a playing surface intersecting along one edge with said first planar member, said playing surface of said third planar member being below said first planar member and being disposed at an angle within the range of 95° and 105° with the playing surface of said first planar member; and means for supporting said apparatus in spaced relation from the floor with the lower edge of the first planar member being at normal table height and with the forward edge of said third planar member being freely suspended above the floor; said support means being such as to allow the players to stand on the floor immediately in front of the forward edge of said third planar member;

said playing surfaces of said second and third planar members being of substantially the same vertical dimension and being wider than they are high; said three playing surfaces constituting the only playing surfaces of the apparatus; the angle between the playing surfaces of said second and first planar members being such as to rebound a ball served with a paddle into contact with said playing surface of said second planar member generally downward into contact with the playing surface of said third planar member; and said angle between the playing surfaces of the first and third planar members being such as to rebound said ball in the general direction of the two players.

2. A game apparatus as claimed in claim 1 wherein the game apparatus is played with a paddle which has no dimension in excess of 11" and has a weight substantially equal to 4.4 ounces.

3. A game apparatus as claimed in claim 1 wherein the widths of all three planar members is equal to approximately 48 inches.

4. A game apparatus as claimed in claim 1 wherein the vertical dimension of said first named planar member is equal to approximately 24".

5. A game apparatus as claimed in claim 1 wherein the vertical dimension of said second planar member is equal to approximately 30".

6. A game apparatus as claimed in claim 1 wherein the vertical dimension of said third planar member is equal to approximately 30".

7. A game apparatus as claimed in claim 1 wherein the lower edge of the vertical playing surface of the first named planar member is 30" from the horizontal surface upon which players of the game stand.

8. A game apparatus as claimed in claim 1 wherein a service zone for the game is defined as the front edge of the third planar member extending a discrete distance on either side of a front to rear centerline of said third planar member and the area between a pair of vertical planes extending perpendicular to said front edge at said discrete distances from said centerline.

9. A game apparatus as claimed in claim 8 wherein said discrete distances are approximately 14" on either side of said centerline.

10. A game apparatus as claimed in claim 8 wherein the sum of said discrete distances is equal to approximately one half the width of said third planar member.

11. In combination, a game board and a piece of furniture, said piece of furniture having a base and a vertical support extending above said base, said game board having three planar members mounted on said vertical support, one of said planar members having a generally vertical playing surface disposed substantially perpendicular to a floor upon which two players stand, said surface facing forward of said piece of furniture and being mounted on said vertical support, a second of said planar members carried by said support and forming a common edge with an upper edge of said first-named planar member, said second planar member having a playing surface projecting forwardly and upwardly from said vertical playing surface and forming an angle with said vertical playing surface within the range of 115° and 135°, and a third of said planar members carried by said support and forming a common edge with a lower edge of said first-named planar member, said third planar member resting on said base and having a playing surface projecting forwardly and downwardly from said vertical playing surface with its forward edge freely suspended above the floor forwardly of said base; said third planar member forming an angle with said vertical playing surface within the range of 95° and 105°.

12. In combination, a game board mounted on a free standing stand, said stand comprising a pair of vertical supports joined by a stretcher at the lower end portions thereof, a pair of feet extending transversely fore and aft of said stretcher, said game board having a first generally vertically extending planar member fixed between said vertical supports a predetermined distance from a floor upon which the stand stands, a second planar member pivoted on said vertical supports in close proximity to the upper edge of said first planar member, a third planar member pivoted on said vertical supports in close proximity to said lower edge of said first planar member, said second planar member is angled with respect to said first planar member forwardly and upwardly therefrom and forming an angle of between 115° and 135° with the first planar member, said third planar member is angled with respect to said first planar member forwardly and downwardly therefrom and forming an angle of between 95° and 105° with the first planar member, and means for pivoting said second and third planar members into a position substantially coplanar with same vertical supports.

13. In combination, a game board mounted in a frame carried by a vertical wall, said frame comprising at least two vertically disposed spaced apart vertical sides mounted on said wall, said game board being formed of three planar members with the first planar member secured between said spaced sides and having a playing surface disposed generally vertically and perpendicular to a floor upon which two players stand, the second of said planar members being pivoted to the upper edge of said first planar member and having a playing surface disposed at an angle within the range of 115° and 125° with the playing surface of said first planar member, the third of said planar members being pivoted to the lower edge of said first planar member and having a playing surface disposed at an angle within the range of 95° and 105° with the playing surface of said first planar member, and means for positioning said second and third planar members at said selected angle with respect to said first planar member.

* * * * *